United States Patent [19]

Endo et al.

[11] Patent Number: 4,522,237

[45] Date of Patent: Jun. 11, 1985

[54] APPARATUS FOR DISPENSING LIQUIDS

[75] Inventors: Keizo Endo, Yokohama; Hiroshi Matsumura, Kamakura; Yoshifumi Hasunuma, Yokohama; Siro Masai; Noboru Oguma, both of Kanagawa, all of Japan

[73] Assignee: Tokyo Tatsuno Co., Ltd., Tokyo, Japan

[21] Appl. No.: 396,199

[22] Filed: Jul. 8, 1982

[30] Foreign Application Priority Data

| | | | |
|---|---|---|---|
| Aug. 20, 1981 | [JP] | Japan | 56-129326 |
| Aug. 20, 1981 | [JP] | Japan | 56-129327 |
| Aug. 20, 1981 | [JP] | Japan | 56-129328 |
| Aug. 21, 1981 | [JP] | Japan | 56-130237 |

[51] Int. Cl.[3] ..... B67C 5/377; B65B 3/36

[52] U.S. Cl. ..... 141/95; 141/128; 141/198; 222/14; 222/16; 222/20; 222/23

[58] Field of Search ..... 222/14, 16, 17, 20, 222/23; 141/128, 192–229, 346–362, 285–310, 37–70

[56] References Cited

U.S. PATENT DOCUMENTS

| | | | |
|---|---|---|---|
| 3,520,338 | 7/1970 | Vest et al. | 141/128 |
| 3,586,069 | 6/1971 | Vest et al. | 141/128 |
| 3,586,070 | 6/1971 | Daniels | 141/128 |
| 3,586,071 | 6/1971 | McGahey et al. | 141/128 |
| 3,586,072 | 6/1971 | McGahey et al. | 141/128 |
| 3,586,073 | 6/1971 | Vest et al. | 141/128 |
| 3,595,281 | 7/1971 | Laub | 141/128 |
| 3,651,837 | 3/1972 | Murray | 141/128 |
| 3,688,813 | 9/1972 | Mayer | 141/128 |
| 3,774,656 | 11/1973 | Mayer | 141/128 |
| 3,916,961 | 11/1975 | Dilger | 141/128 |
| 3,918,475 | 11/1975 | Trusselle | 141/128 |
| 3,920,056 | 11/1975 | Piecuch | 141/128 |
| 3,921,682 | 11/1975 | McGahey et al. | 141/128 |

*Primary Examiner*—Houston S. Bell, Jr.
*Attorney, Agent, or Firm*—Jordan and Hamburg

[57] ABSTRACT

An apparatus for dispensing a liquid, for instance gasoline and the like fuel to vehicles, especially in the manner of the so-called "full tank dispensation", includes a dispensing nozzle with a liquid level sensor at the tip end thereof and a circuit for receiving signals from the level sensor to control flow-out of fuel from the nozzle, the circuit issuing a signal to stop the flow-out in response to receipt of a fuel detection signal from the level sensor after a predetermined time period has lapsed, issuing another signal to recommence the flow-out and if it receives from the level sensor a signal indicating the absence of fuel.

17 Claims, 10 Drawing Figures

APPARATUS FOR DISPENSING LIQUIDS

BACKGROUND OF THE INVENTION

1. Field of the Invention

The present invention relates to an apparatus for dispensing a liquid, for instance gasoline and the like liquid fuel to vehicles, and more particularly to such apparatus of the type wherein so-called "full tank dispensation" can automatically be accomplished.

2. Description of the Prior Art

The fuel dispensing services in commercial gasoline stations are generally classified into so-called "amount designated dispensation" wherein an operator dispenses fuel in an amount requested by a customer and so-called "full tank dispensation" wherein the operator dispenses the fuel until a fuel tank in the customer's vehicle is filled with the fuel. The full tank dispensation system is troublesome for the operator, since he must manually control a lever of the dispensing nozzle to dispense the fuel in the vehicle fuel tank which already contains an unknown amount of fuel and fill that fuel tank with the dispensed fuel while under his visual control. Manual operation under such visual control has a problem in that it is not always possible to avoid a possible overflow due to excess dispensation.

In order to solve the problem, there has been proposed an automatic dispensing nozzle with a fuel level sensor at the tip which detects the fuel and issues a signal to automatically stop flow of the fuel from the nozzle (for instance, U.S. Pat. No. 3,085,600, BP No. 955 163). In theory, such device is arranged so that the level sensor contacts the actual surface of the fuel in a vehicle fuel tank to issue the fuel detection signal and stop the fuel dispensing operation. Depending on the sectional configuration of the inlet part of the fuel tank, the level sensor contacts the splash of the fuel on the rebound of the fuel discharged from the dispensing nozzle into the fuel tank or a fuel bubble which is formed by the fuel discharge and which rises up prior to the actual fuel level in the fuel tank to issue the fuel detection signal. As a result, the fuel dispensing operation stops prior to the time that the fuel tank has completely been filled with the fuel.

For filling the fuel tank with fuel with use of such a prior art device, therefore, the operator must manually reopen a valve to recommence the fuel dispensation. In this case, it is necessary for the operator to squeeze the valve in order to avoid a too-early issuance of the fuel detection signal by the level sensor due to the splash or bubble of fuel. However, such valve operation requires a some skill. In other words, non-skilled operators may recommence the fuel dispensing operation at a large discharging rate and as a result, he must repeat the fuel dispense recommencing opertion, until the fuel tank is completely filled with the fuel. This reduces the working efficiency.

SUMMARY OF THE INVENTION

A basic object of the invention is to provide a liquid dispensing apparatus which can dispense a liquid such as gasoline or the like liquid in a fuel tank for each vehicle and to completely fill the tank with the fuel without requiring skill in its operation, thereby making possible automatic full tank dispensation.

According to the invention, the above basic object can be attained by an apparatus for dispensing a liquid, which comprises a liquid reservoir, means for pumping the liquid from the reservoir, electric motor means for actuating the pump means, flow meter means for measuring the amount of the liquid passing therethrough, means for indicating the amount of liquid measured by the flow meter means, valve means for controlling the flow of the liquid passing therethrough, a first stationary conduit connecting the pump means to the reservoir, a second conduit connecting the flow meter means to the pump means, a third conduit connecting the valve means to the flow meter means and a fourth conduit connected to as outlet of the valve means, a flexible conduit means connected to a free end of the fourth conduit, dispensing nozzle means connected to a free end of the flexible conduit means and having a liquid level sensor means at the tip end thereof, and a control circuit connected electrically to the level sensor means to issue a signal to automatically stop flow-out of the liquid from the nozzle means in response to receipt of a liquid detection signal from the level sensor means, issued after a predetermined time period has lapsed, another signal for recommencing the flow-out of liquid from the nozzle means if it receives from the level sensor means the signal showing the absence of liquid, and then finally issue the signal for stopping the flow-out of the liquid.

An additional object of the invention is to provide such liquid dispensing apparatus wherein whether or not the level sensor means operates normally can be confirmed prior to the liquid dispensing operation to avoid possible excessive dispensation due to a defect in the level sensor means.

Another additional object of the invention is to provide such liquid dispensing apparatus which is able to dispense a liquid only when the level sensor means is in a normal state, and which is operated at a high discharging rate at the beginning of the dispensing operation and in subsequent automatic dispensation, recommencing operation after finishing the first dispensing operation due to the level sensor means contacting the rebounded splash or raising bubbles to issue the liquid detection signal, the rate of discharge being decreased stepwise each time to improve the dispensing efficiency.

According to the invention, such additional objects can be attained by the aforesaid apparatus, wherein the control circuit comprises a level sensor signal judging circuit which is connected to the level sensor means through a protective barrier circuit to judge whether the level sensor means actuates is in a normal state or not and issue as an output thereof either a normal or an abnormal signal, a motor control circuit which drives the motor means by receiving the normal signal from the judging circuit to actuate the pump means, a valve control circuit which issues a first signal by receiving the normal signal from the judging circuit to feed same to a valve opening memory circuit, receives a signal from the memory circuit and issues a second signal for actuating a valve body arranged in a flow passage in the valve means.

A still additional object of the invention is to provide such liquid dispensing apparatus which is able to dispense a liquid in an amount which does not produce any fraction in the corresponding monetary amount to avoid possible trouble with customers and make the transactions smooth. In this specification, such dispensation will be referred to as "integral dispensation". The term "integral" is not used herein in the mathematical sense.

According to the invention, this additional object can be attained by the aforesaid apparatus which further comprises a control dispensing circuit connected to a counter circuit to be operated by a pulse signal from the flow meter means and controlling the amount of the liquid to be dispensed from the nozzle means into the indicator means to display a zero in second figure of the decimals.

BRIEF DESCRIPTION OF THE DRAWINGS

The drawings illustrate an embodiment of the apparatus according to the invention, wherein.

DESCRIPTION OF THE PREFERRED EMBODIMENT

The invention will now be further explained in detail with reference to a preferred embodiment shown in the Figures. The following explanation will mainly apply to an apparatus for dispensing a fuel to vehicles in the manner of "full tank dispensation".

Figure 1:
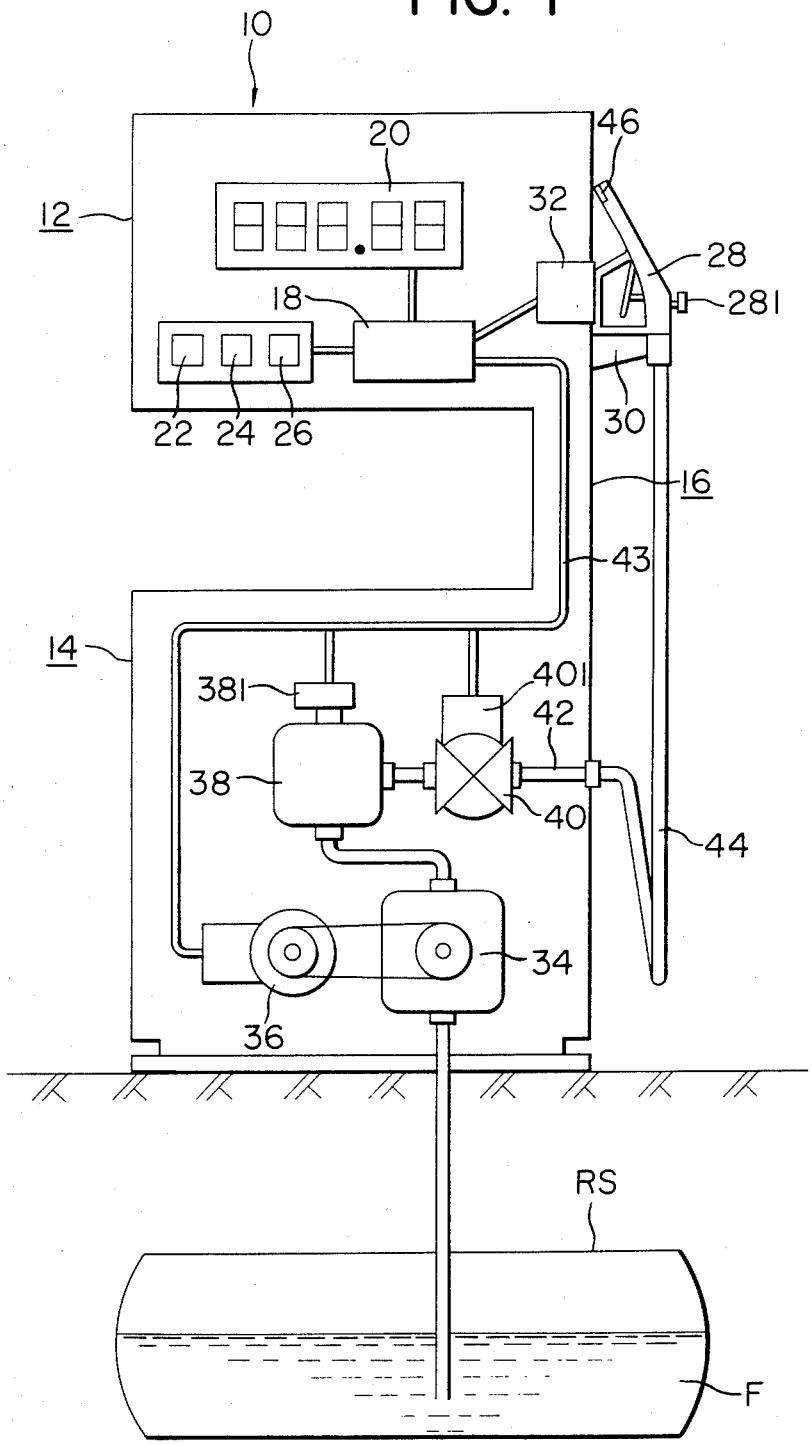
FIG. 1 is a diagrammatic illustration of the apparatus applied for dispensing a liquid such as gasoline or the like liquid fuel accommodated in an underground reservoir.

In FIG. 1, there is shown generally a fuel dispenser according to the invention. A housing of this dispenser 10 consists of an upper case 12, a lower case 14 and a hollow support 16 connecting both of said cases. In the upper case 12, there are arranged a control device 18, an indicator 20 for displaying the amount of dispensed fuel, other indicators 22, 24, 26 which will be described later, and indication concerning members such as a nozzle switch 32 which detects whether a dispensing nozzle 28 is mounted on or demounted from a nozzle hanger 30. In the lower case 14, there are arranged fuel discharging members such as a pump 34 for pumping a fuel F from an underground reservoir RS, an electric motor 36 for driving the pump, a flow meter 38 for measuring the amount of fuel F passing therethrough, a flow control valve 40, and stationary piping 42 extending from a position near the bottom of the underground reservoir RS to the outside of the lower case 14 through the pump 34, flow meter 38 and flow control valve 40. In the hollow support 16, there is arranged wiring 43 which electrically connects the control device 18 with the driving motor 36 in the lower case 14, a signal generator (rotary encoder) 381 operably connected to the flow meter 38 and a valve actuating part 401 of the flow control valve 40.

The nozzle 28 is normally accommodated or hung on the nozzle hanger 30 which is arranged on an outer side wall of the upper case 12. The nozzle 28 is connected through a flexible conduit 44 to the free end of a stationary conduit 42 at a location outside the case 14. The nozzle 28 has a liquid level sensor 46 near the tip end thereof (the structure of the nozzle 28 as well as the structure and arrangement of the liquid level sensor 46 will be described later with reference to FIGS. 5 and 6).

Figure 2:
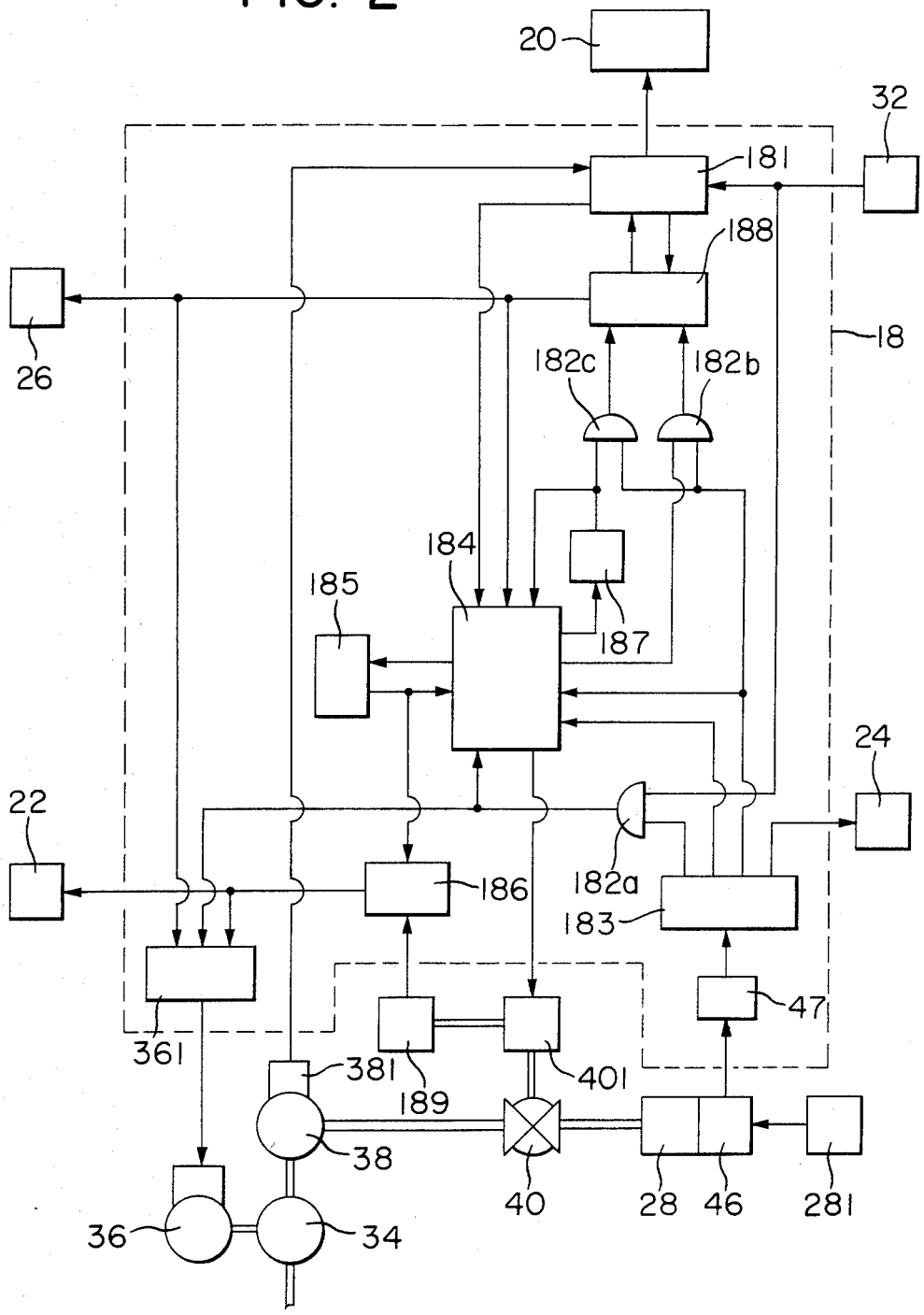
FIG. 2 is a block diagram showing a control circuit employed for the apparatus shown in FIG. 1.

Operation of the apparatus 10 will now be explained with reference to FIG. 2 which illustrates one preferred circuit structure for the control device arranged in the upper case 12 as well as FIG. 3 which illustrates one time chart for fuel dispensation operation.

When the nozzle 28 is demounted from the nozzle hanger 30 (see FIG. 1; this period corresponds to point a in the time chart of FIG. 3), a signal from the nozzle switch 32 is fed to a counter circuit 181 and an AND circuit 182*a*. This erases memory of the value of a previous dispensed fuel amount, which was stored in the counter circuit 181, and thus the indicator 20 is reset to display a zero value. A signal from the liquid level sensor 46 arranged on the nozzle 28 (see also FIG. 1) is applied through a barrier circuit 47 to a sensor signal judging circuit 183 to check whether the liquid level sensor 46 is operated normally (details of the liquid level sensor, barrier circuit and sensor signal judging circuit will be described later with reference to FIGS. 7 and 8). In the checking operation, a normal state, is confirmed when the liquid level sensor 46 is in a state that it detects no liquid and can detect the liquid, or if there is otherwise an abnormal state. In the latter case, a signal from the sensor signal judging circuit 183 is fed to a defect indicator 24 to visibly or audibly transmit the fact to an operator so that he can take a suitable counter measure. When normal operation of the liquid level sensor 46 is confirmed, the output signal of the sensor signal judging circuit 183 is applied to one of the input terminals of the AND circuit 182*a*.

The AND circuit 182*a* issues an output signal, when it receives both signals from the sensor signal judging circuit 183 and the nozzle switch 32. The output signal is applied to a motor control circuit 361 to actuate the electric motor 36 and make the pump 34 ready for its operation, and is applied also to a valve control circuit 184. The valve control circuit 184 is adapted to issue a valve opening reading out signal to a valve opening memory circuit 185 and receive a reply signal therefrom, when the circuit 184 receives a signal from the AND circuit 182*a* (the reply signal is also fed to a valve opening judging circuit 186 but this will be explained later). The valve opening memory circuit 185 stores memories of several valve opening degrees to attain various discharges from a maximum to a minimum. In the embodiment as shown in FIGS. 3 and 4, steps for discharging the liquid at a rate of 3 l/min, 20 l/min, 30, l/min and 45 l/min are set as the memories to feed a corresponding signal of 10, 30, 40 or 60 pulses to a valve actuating part 401 from the valve control circuit 184. The valve opening memory circuit 185 has another memory to feed minimum discharge signals of 10 pulses to the valve actuating part 401 through the valve control circuit 184, at the beginning state, namely, when it receives the reading out signal from the valve control circuit 184.

As the valve actuating part 401 for operating the valve mechanism for the flow control valve 40, a stepping motor is preferable, which is so adapted that it is driven by the signal of 10 pulses to make the valve opening correspond to the minimum discharge and by a signal of 60 pulses to make the valve opening correspond to the maximum discharge.

By receiving the reading out signal from the valve control circuit 184, the valve opening memory circuit 185 issues, as aforesaid, the minimum discharge signal of 10 pulses (3 l/min) as the reply or valve opening signal to the valve control circuit 184, and this signal is then fed to the valve actuating part (stepping motor) 401 to set the opening of the valve mechanism for the flow control valve 40 as that corresponding to the minimum discharge. This time period is shown as b in FIG. 3.

If the operator inserts the tip end of the dispensing nozzle 28 in an inlet of a vehicle fuel tank and operates the dispensing lever thereof, fuel dispensation is commenced at the rate of such minimum discharge. This time period is shown as point c in FIG. 3. As described later, the full tank dispensation with use of the apparatus according to the invention stops automatically and thus the operator undertakes another service operation, if he engages the dispensing lever to its latch to keep the dispensing nozzle in its discharging state.

With the fuel dispensation, the encoder 381 of the flow meter 38 converts the amount of the fuel passing through the flow meter 38 into a pulse signal which is fed to the counter circuit 181. A signal representing the number of pulses counted by the counter circuit 181 is fed to the indicator 20 to display the the amount of dispensed fuel. The opening of the valve mechanism for the flow control valve 40 is set at the minimum discharge (3 l/min) as described before and thus, even if the dispensing lever of the nozzle 28 is operated before inserting the tip end of the nozzle into an inlet of vehicle fuel tank due to a possible mistake by the operator, for instance when the nozzle 28 is demounted from its hanger 30, the amount of fuel discharged on the ground will be small.

When the counts circuit 181 counted a predetermined number of the pulse signal issued from the encoder 381 of the flow meter 38, for instances 5 pulses corresponding to 0.05 liters of dispensed fuel, a signal is issued from the counter circuit 181 and fed to the valve control circuit 184. This time period is shown as point d in FIG. 3. By receiving the signal from the counter circuit 181, a valve control circuit 184 issues the valve opening reading out signal to the valve opening memory circuit 185 which issues, as a reply, a signal of 50 pulse (60−10=50) corresponding to the maximum discharge (45 l/min) to feed the same to the valve control circuit 184. The reply signal is fed to the valve actuating part 401 to drive the stepping motor constituting the valve actuating part 401 by 50 pulses to operate the valve mechanism for the flow control valve 40 to its full open position and to commence maximum discharge. This time period is shown with point e in FIG. 3. A sudden change from the minimum to maximum discharge causes an unsuitable situation of too early detection of the fuel by the liquid level sensor 46 due to splashing of the discharged fuel. In order to avoid such situation, a transition of 2 seconds is set between the minimum and maximum discharges as shown in FIG. 3.

When the vehicle fuel tank nears its full state as a result of such fuel dispensation under the maximum discharging condition, and the liquid level sensor 46 detects the fuel by contact with the raising bubbles or splash of the discharged fuel, a liquid detection signal is issued from the liquid level sensor 46 and is fed through the barrier circuit 47 to the sensor signal judging circuit 183. An output signal of the circuit 183 is then applied to the valve control circuit 184. This time period is shown with point f in FIG. 3. In this case, the valve opening reading out signal is issued from the valve control circuit 184 to the valve opening memory circuit 185. The resulting read out signal of 60 pulses is fed through the valve control circuit 184 to the valve actuating part 401 to reversely drive the stepping motor by 60 pulses, so that the valve mechanism for the flow control valve 40 is operated to its fully closed state. This time period is shown with point g in FIG. 3.

Let it be assumed that the liquid detection signal was issued from the liquid level sensor 46 by contact with rising fuel bubbles. Several seconds are required until the bubbles disappear. Therefore, even if the valve mechanism for the flow control valve 40 is operated to its fully closed state and thus the discharge of fuel F from the nozzle 28 stops, the liquid level sensor 46 continuously issues the liquid detection signal. When the valve mechanism of the flow control valve 40 is in its fully closed state, a signal is fed from the valve control circuit 184 to a timer 187 which issues a signal and feeds the same to the valve control circuit 184, after a lapse of a predetermined time period, for instance 3 seconds, by taking the bubble disappearing time into consideration. This time period is shown with point h in FIG. 3. In that time, namely after 3 seconds have lapsed from the time when the valve mechanism of the flow control valve 40 is closed, there is issued no liquid detection signal from the liquid level sensor 46, since the fuel bubbles have already disappeared.

By receiving the signal from the timer 187, the valve control circuit 184 issues the valve opening reading out signal to the valve opening memory circuit 185 similar to the point d but in this case, the valve opening signal issued from the valve opening memory circuit is that of 40 pulses and thus the fuel dispensing operation is recommenced with a corresponding discharging rate, for instance 30 l/min. This time period is shown with point i in FIG. 3. Since the vehicle fuel tank is already in a near full state, the liquid level sensor 46 will issue at an earlier time the liquid detection signal to commence the valve closing operation as in the aforesaid manner. This time period is shown with point j in FIG. 3. Points k and l in FIG. 3 show respectively the time periods for the completion of the valve closing operation as in the point g and recommencement of fuel dispensation as in the point h. Point m is similar to point i but in this case, the discharging rate is set as 20 l/min. In other words, the valve actuating part 401 is driven by 30 pulses at the point l.

Figure 3:
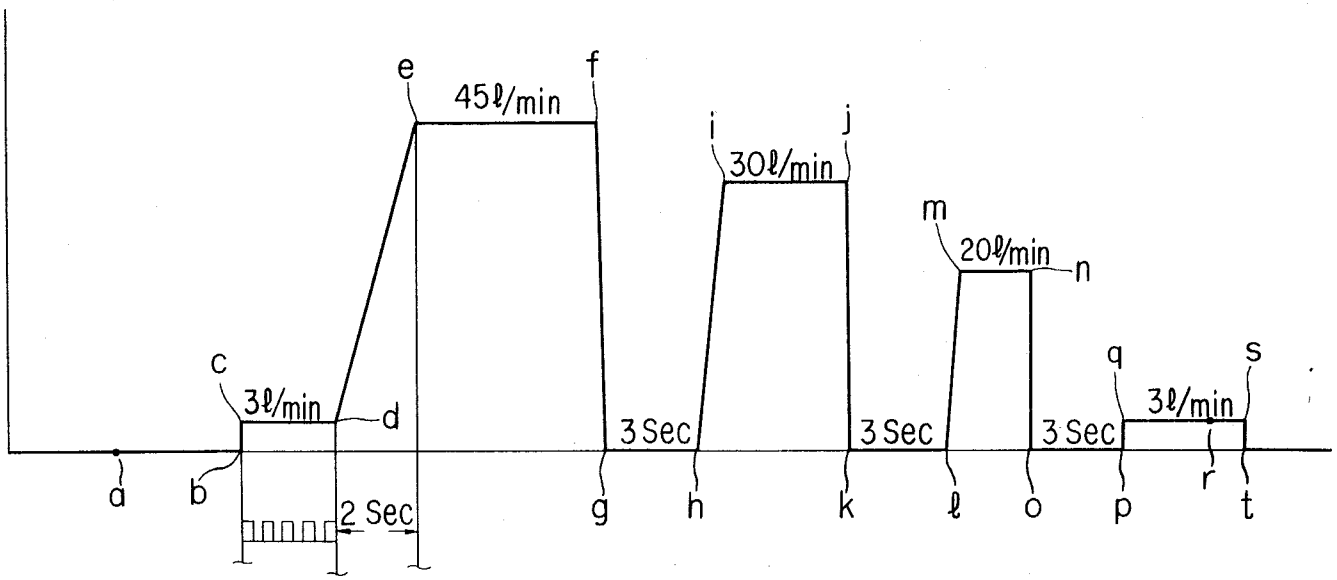
FIG. 3 is a time chart showing one arrangement for controlling the amount of the liquid to be discharged from the dispensing nozzle by adjusting an opening in a valve means.
Figure 4:
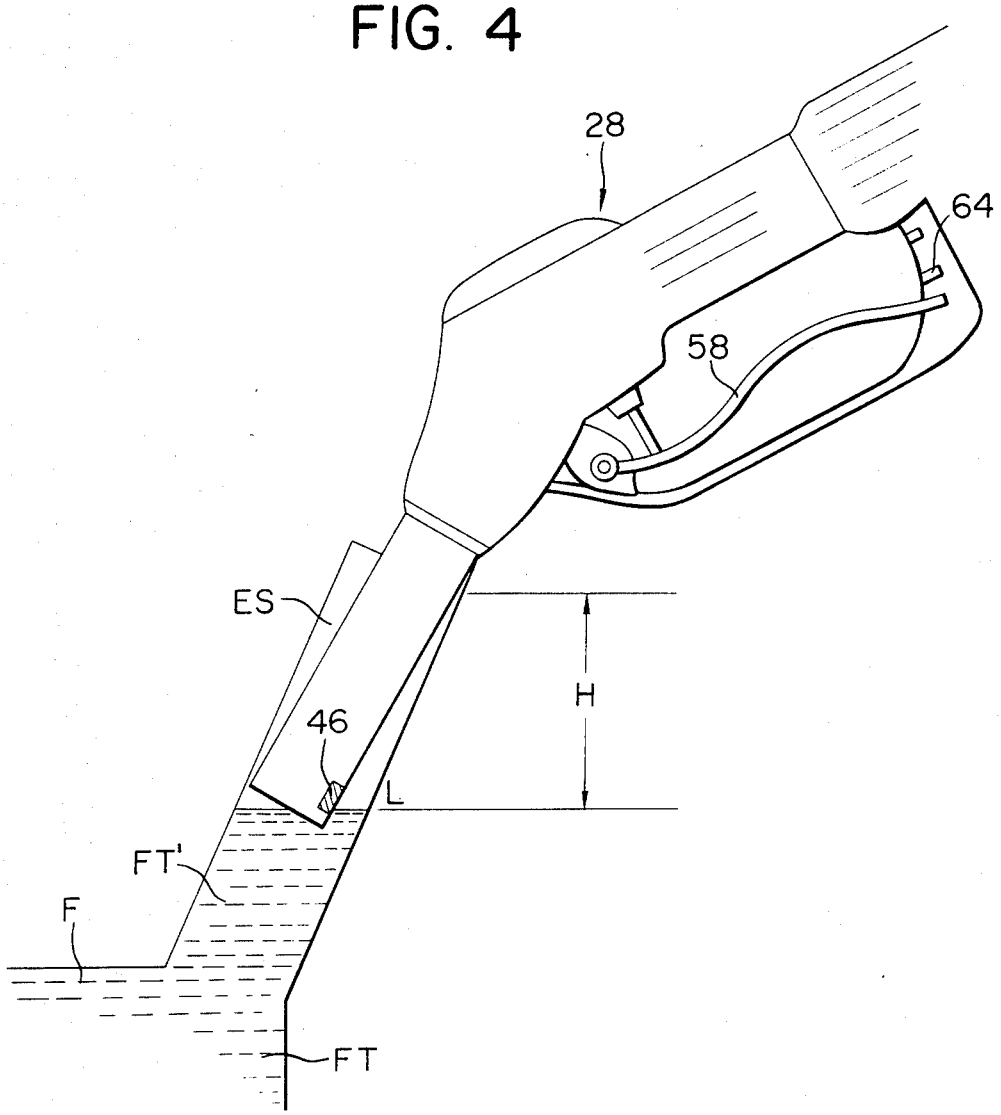
FIG. 4 is a diagrammatic illustration showing a tip end of a dispensing nozzle inserted in an inlet of a vehicle fuel tank to show in detail the relation between a level sensor arranged at tip end of the nozzle and the fuel level in the tank.

A third liquid detection point is shown with point n in FIG. 3. The valve closing operation in this stage is carried out in a similar manner as in the points f and j in the previous stage, so that the valve mechanism of the flow control valve 40 moves to its closed state. This time period is shown with point o in FIG. 3.

If the liquid detection signal from the liquid level sensor 46 disappears, namely the vehicle fuel tank has not yet been fully filled with the fuel, the valve opening operation is again carried out. The beginning point of this fourth valve opening operation is shown with point p in FIG. 3. In this case, the signal fed from the valve opening memory circuit 185 to the valve actuating part 401, in response to the valve opening reading out instructions from the valve control circuit 184, is 10 pulses. Thus fuel dispensation is carried out with the minimum discharge of 3 l/min. This time period is shown with point q in FIG. 3. At this time, a signal is issued from the valve control circuit 184 and continuously applied to an AND circuit **182*b*. Another input terminal of the AND circuit 182*b* is connected with the liquid level sensor 46 through the sensor signal judging circuit 183 and the barrier circuit 47. When receiving the signal from the valve control circuit 184 and the liquid detecting signal from the liquid level sensor 46, the AND circuit 182*b* issues an output signal (this time period is shown with point r in FIG. 3) which is fed to an integral dispensation control circuit 188. In this case, a dispensed fuel amount reading out signal is fed from the integral dispensation control circuit 188 to the counter circuit 181 and the resulting read-out signal is fed back to the integral dispensation control circuit 188 to indicate the liquid amount so that the second figure of the decimals in liters is zero. Although the operation may provide for finding a value for the second figure of the decimals, there is a possible case of in sufficient time of the response of the valve mechanism for the flow control valve 40. It is preferable, therefore, to set the operation so as to have the second figure of the decimal to read zero. For example in the case of 23.54 liter, 6 pulses are fed to make the dispensed fuel amount read 23.60 liter and in case of 23.59 liter, not 1 but 11 pulses are fed to make the final amount read 23.70 liter. After having additionally counted the number of such pulses by the counter circuit 181, a dispensation stop signal is fed from the integral dispensation control circuit 188 to the valve control circuit 184 (this time period is shown with point s in FIG. 3), such stop signal is then fed to the valve actuating part 401 to fully close the valve mechanism for the flow control valve 40 and to complete the dispensation operation (this time period is shown with point t in FIG. 3). Such stop signal is fed both to a dispensation finish indicator 26 and a motor control circuit 361 to visibly and/or audibly indicate the completion of the dispensation operation and to stop the actuation of the electric motor 36**, respectively.

Let it be assumed in such dispensing operation that the vehicle fuel tank is filled up to fuel at a particular time, for instance at the time indicated by the point g, k or o, and the liquid detection signal is continuously issued from the liquid level sensor 46, even if the valve opening signal is issued from the timer 187 after a predetermined time period has lapsed, for instance 3 seconds as aforesaid. In such a case, the liquid level sensor 46 still contacts the fuel per se, even when the fuel bubbles in the vehicle fuel tank have disappeared. In this case, an AND circuit **182*c* having an input terminal connected to the liquid level sensor 46 and another input terminal connected to the timer 187 issues an output signal which is fed to the integral dispensation control circuit 188** to carry out the operations as referred to in the previous paragraph and to complete the fuel dispensation operation.

According to the embodiment as referred to hereinbefore, the valve opening-closing operations are repeated with the aid of the liquid level sensor 46 and in the second or subsequent valve opening operation, while automatically squeezing the opening of the valve at each dispensing stage into such a level as avoiding a possible contact of the liquid level sensor 46 with the splash of the discharged fuel, so that number of the dispensing stages for full tank dispensation can be decreased to increase the total fuel dispensation efficiency without causing any over flow of the fuel from the vehicle fuel tank.

In the above embodiment, the valve (flow control valve 40) is throttled stepwise but it also may be continuously throttled, for instance from the point f in FIG. 3. Further, the flow control by the valve actuation part 401 may be carried out with rotational velocity control of the electric motor 36 which actuates the pump 34.

In the aforesaid embodiment, the fuel discharging rate is controlled based on the detection of fuel by the liquid level sensor 46 but this control may be carried out based on the amount of fuel previously dispensed or on the time required from recommencement of fuel dispensation to the next detection of the fuel by the liquid level sensor 46.

There is a possible case that it is preferable to maintain the discharging rate constant, for instance at a high discharging rate, without throttling the valve. For this purpose, a dispensation selection switch 281 is arranged on the nozzle 28 (see also FIG. 1). When the switch 281 is turned-on, the signal from the liquid level sensor 46 to the sensor signal judging circuit 183 through the barrier circuit 47 is fed as a dispensation selection one signal to the valve control circuit 184. In this case, a full opening signal is issued from the valve opening memory circuit 185, in response to a reading out signal from the valve control circuit 184, to move the valve mechanism for the flow control valve 40 to its full-open state. If the liquid level sensor 46 issued the liquid detection signal, the valve closing operation will be carried out in the same manner as referred to before to move the valve mechanism for the flow control valve valve 40 in its fully closed state. The valve opening and closing operations will be repeated until the liquid level sensor 46 continuously issues the liquid detection signal over a predetermined time period, for instance 3 seconds.

FIG. 4 shows an operating condition in which fuel dispensation is carried out by inserting the cylindrical part of the nozzle 28 into a neck portion FT′ of a vehicle fuel tank FT and actuating a dispensing lever 58. The fuel F reaches to a level L where the liquid level sensor 46 mounted in the tip end of the nozzle 28 continuously issues a liquid detection signal. As illustrated in the figure, the neck portion of the fuel tank FT has in general a cylindrical configuration and thus the fuel tank FT has a space ES with a height H, which may accommodate an additional amount of fuel. In automobiles, usually 0.20 liter or more can be accommodated in the space ES and thus additional fuel dispensation can be carried out without causing any over-flow, if the fuel amount is less than 0.15 liter.

According to the invention, the space ES is utilized for the aforesaid integral dispensation to provide the zero in the second figure of the decimals on the display of the dispensed fuel amount or to avoid producing any fraction in the monetary amount corresponding to the dispensed fuel amount, or for additional dispensation in a constant amount, which is to be carried out when the dispensed fuel reaches to the level L to attain a more complete full tank dispensation.

An exemplar liquid level sensor to be employed for the invention will now be explained with reference to FIGS. 5, 6*a* and 6*b*.

Figure 5:
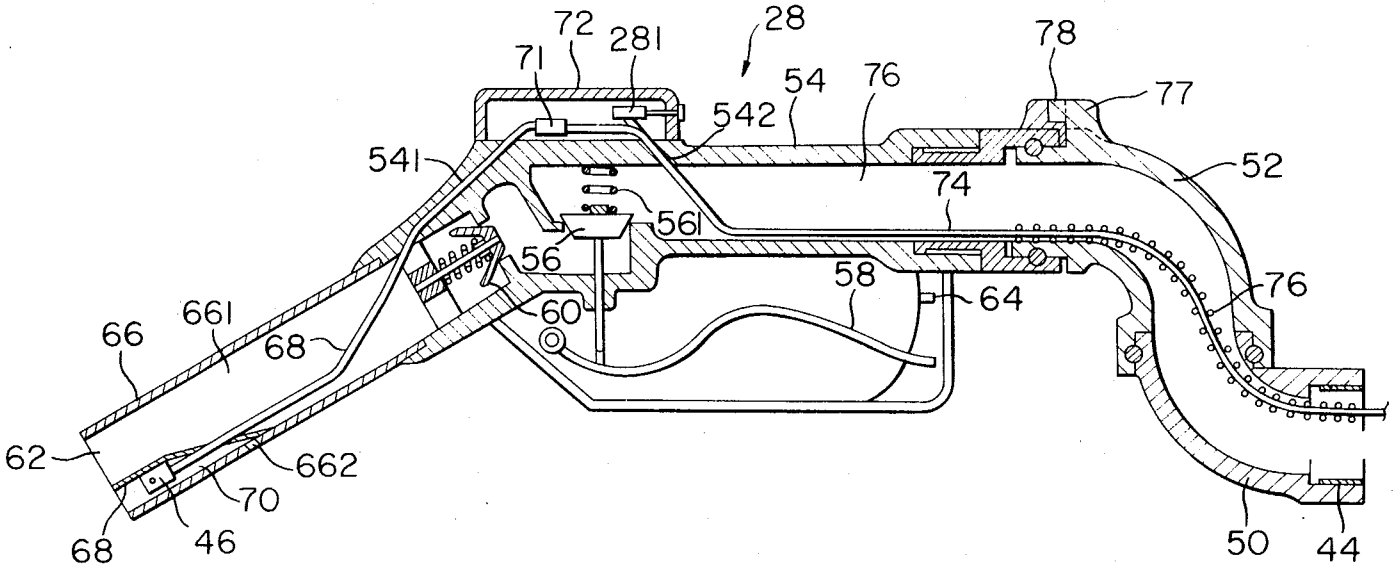
FIG. 5 is a longitudinal sectional view of the dispensing nozzle.

A structure per se of the dispensing nozzle 28 shown generally in FIG. 5 has been known in the art. A nozzle body 54 is rotatably connected to the flexible conduit 44 through a swivel 52 and a fitting 50. A main valve 56 arranged in a bore formed in the nozzle body 54 can be opened against the force of a spring 561 by operating the dispensing lever 58. The fuel will be dispensed from a nozzle aperture 62 through the main valve 56 and a check valve 60 which is arranged in the bore downstream of the main valve 56. A member shown by reference numeral 64 is a latch for maintaining the lever 58 in its operating position; namely, for keeping the main valve 56 in its open state.

The liquid level sensor 46 is mounted in a cylindrical part 66 of the nozzle body 54 at a position near the nozzle aperture 62 and is separated by a partition plate 68 from a fuel passage 661. Thus it shall not be affected by the fuel passing through the passage 661. An aperture 662 is formed in the nozzle cylindrical part 66 at a position corresponding to a space 70 wherein the liquid level sensor 46 is mounted, the aperture 662 making easy flow-in of fuel into the space 70 at the time of fuel detection.

Figure 6A:
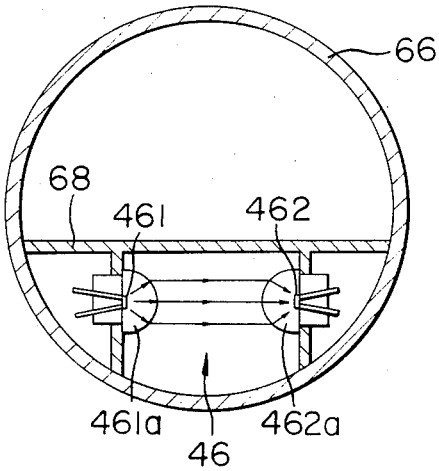
FIGS. 6*a* and 6*b* show respectively the condition where the medium between the two elements for the level sensor is air or liquid.
Figure 6B:
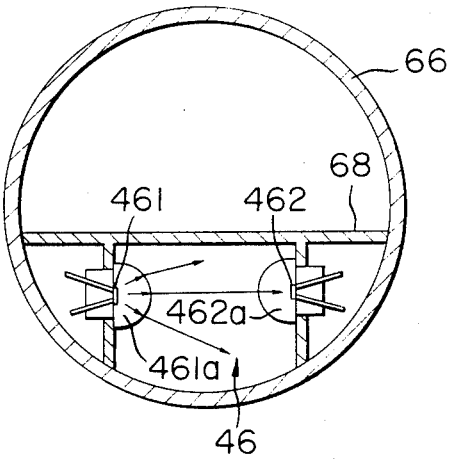

FIGS. 6*a* and 6*b* show the liquid level sensor 46 as seen from the side of the nozzle aperture 62 in FIG. 5 in a state where it does not detect any fuel in a state and where it is detecting the fuel, respectively. Any type of liquid level sensors may be employed but in the illustrated embodiment, the liquid level sensor 46 comprises a light emitter 461, a light receiver 462 and two lenses 461*a*, 462*a*, each of which is attached to the light emitter 461 and light receiver 462, respectively. The light emitter 461 and light receiver 462 may be a light emission diode to emit a pulse beam and a phototransistor which will be made into its through-state by receiving the beam from the diode. The lenses 461*a* and 462*a* serve to make the light emitted from the diode 461 a parallel beam when the medium is air and to condense or converge the parallel beam on the phototransistor 462, respectively.

Therefore, if the medium between the light emitter 461 and light receiver 462 is air, the light from the light emitter 461 is made a parallel light beam by the lens 461*a*, transmitted to the other lens 462*a* and condensed by the lens 462*a* on the light receiver 462 to issue an electric output therefrom, as shown in FIG. 6*a*. While if the medium between the light emitter 461 and light receiver 462 is a fuel, the light from the light emitter 461 is not only weakened by the photo-passing resistance of the fuel per se but also scattered by a change of the refraction index of the lens 461*a* due to the presence of fuel, as shown in FIG. 6*b*. Therefore, almost no light reaches the light receiver 462 and thus the light receiver issues no output or a very low level output.

As a result, it can easily be judged whether the liquid level sensor 46 contacts with and detects the fuel or not.

The wiring for the liquid level sensor 46 will now be explained with reference also to FIG. 5. Signal lines 68 each of which is connected to the light emitter 461 and light receiver 462, respectively at one end is led outside of the nozzle body 54 through the fuel passage 661 in the cylindrical nozzle part 66 and a bore 541 formed in the nozzle body 54. The lines 68 are connected to a connector 71 which serves for repairing or exchanging the liquid sensor 46. In the illustrated embodiment, the fuel dispensation selection switch 281 is also arranged outside of the nozzle body 54, this switch 281 and the connector 71 being covered by a removable common lid 72. An operation button 281*a* for the switch 281 extends to the outside of the lid 72 and is pushed down to repeat full open-full close operations of the flow control valve 40, as referred to before. A signal line to the connector 71 and another signal line to the switch 281 are made together as line 74, led again into the nozzle body 54 through a bore 542, and finally connected to the control device 18 (FIG. 1). The signal line 74 is covered with a coil spring 76 where it passes through the swivel 52 in order to reduce the extent of twist, but this counter measure is not sufficient for avoiding a possible break down of the signal line due to the twist. Therefore there is arranged means 78 for restricting the relative rotation between the swivel 52 and the nozzle body 54.

The sensor circuit will now be explained with reference mainly to FIGS. 7 and 8. The sensor circuit comprises mainly the light emitter 461 and light receiver 462 of the liquid level sensor 46, the barrier circuit 47, and the sensor signal judging circuit 183 (see also FIG. 2). The sensor circuit is actuated by receiving a signal from the nozzle switch 32, when the nozzle 28 is demounted from the nozzle hanger 30, and deactuated when the nozzle 28 is mounted on the nozzle hanger 30 (see also FIG. 1). The barrier circuit 47 comprises a fuse F, resistors R and zener diodes Z but an explanation thereof will not be made, since circuit structure per se has been known in the art.

Figure 7:
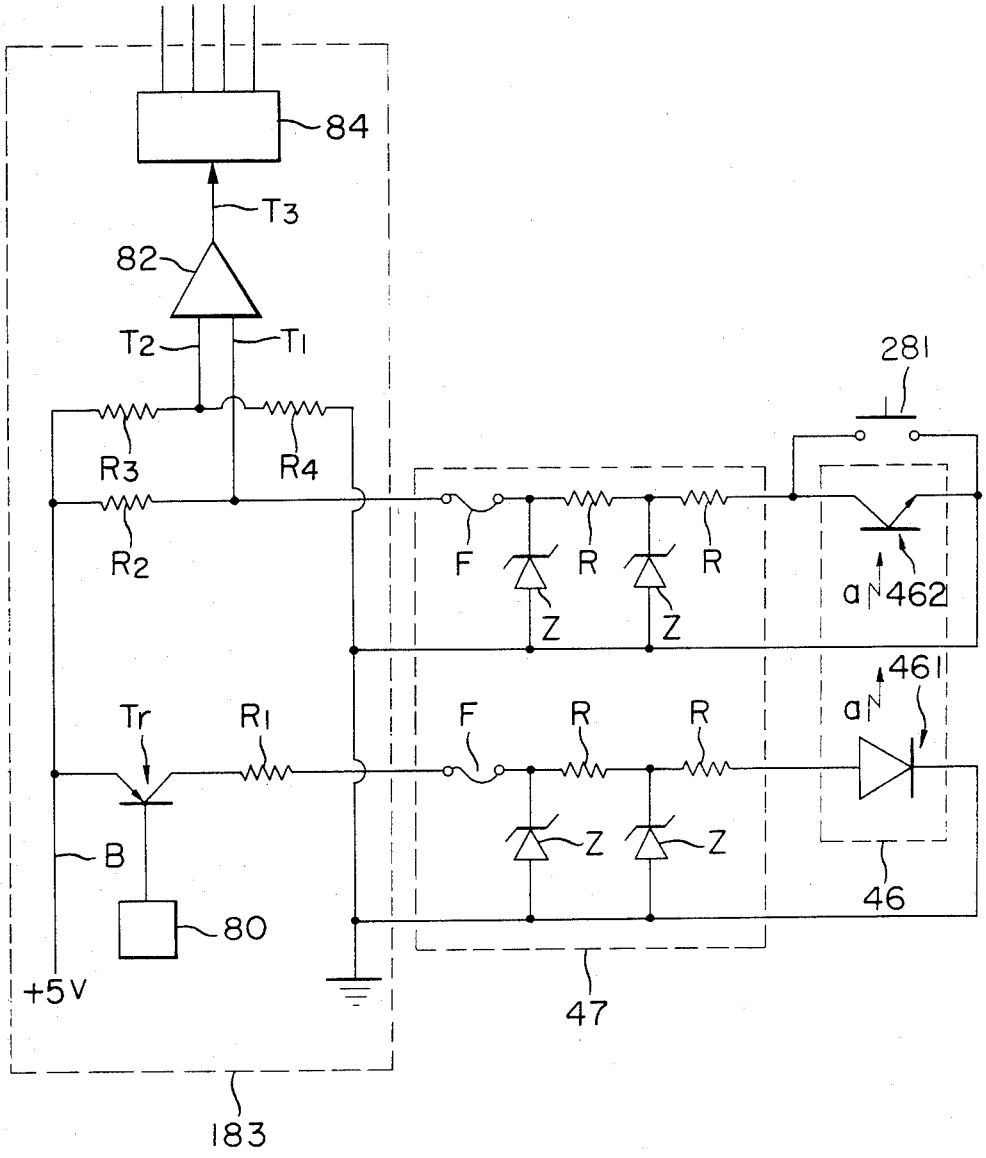
FIG. 7 shows a wiring diagram for a sensor circuit.

In the embodiment illustrated in FIG. 7, it is assumed that the light emitter 461 and light receiver 462 are a light emission diode and phototransistor, respectively, as stated before. In the sensor signal judging circuit 183, a bus B of for instance +5 V is connected to an emitter of a transistor Tr having a base connected to an oscilator 80. The oscilator 80 issues pulse signals as shown in FIG. 8(*a*), and thus a corresponding pulse signal is issued at the collector side of the transistor Tr. The pulse signal is applied to the light emission diode 461 through a resistor $R_1$ and the barrier circuit 47 and thus, the light emission diode 461 issues a light pulse signal having a wave form similar to that as illustrated in FIG. 8(*a*). The cathode side of the diode 461 is grounded.

The collector of the phototransistor 462 is connected to the bus B through the barrier circuit 47 and a resistor $R_2$ and the emitter thereof is grounded.

Further, a comparator 82 is arranged to convert the pulse signal into a signal with a rectangular wave form. The comparator 82 has a first input terminal $T_1$ connected to a line between a resistor $R_2$ and the phototransistor 462 and a second input terminal connected between two resistors $R_3$ and $R_4$ having the same resistance and connected in series in a line which connects the bus B and earth and thus a half of the bus B voltage, namely +2.5 V is applied on the terminal $T_2$.

If a sufficient light pulse beam reaches from the light emission diode 461 to the phototransistor 462 as shown by arrows a, the phototransistor 462 is made into its through-state to reduce the voltage at the terminal $T_1$ to less than +2.5 V. While if the phototransistor 462 receives no light pulse beam or an insufficient light pulse beam, the phototransistor keeps its non through-state to increase the voltage at the terminal $T_1$. Since the voltage signal at the terminal $T_1$ is inverted from the signal issued by the oscilator 80, an output signal of the comparator 82 has an inverted wave form as shown in FIG. 8(*a*) [the wave form is shown in FIG. 8(*b*) and left parts of FIGS. 8(*c*) and (*d*)]. FIG. 8(*b*) shows an output signal of the comparator 82, in the case where the medium between the light emission diode 461 and the phototransistor 462 is air and that the light pulse signal is sufficiently supplied from the light emission diode 461 to the phototransistor 462 to turn the same into its through-state. FIG. 8(*c*) shows the output signal of the comparator 82, in the case where the medium between the light emission diode 461 and the phototransistor 462 is changed from air to a fuel or its bubble at the time period as shown by X; namely, showing a high level signal Hi.

Figure 8:
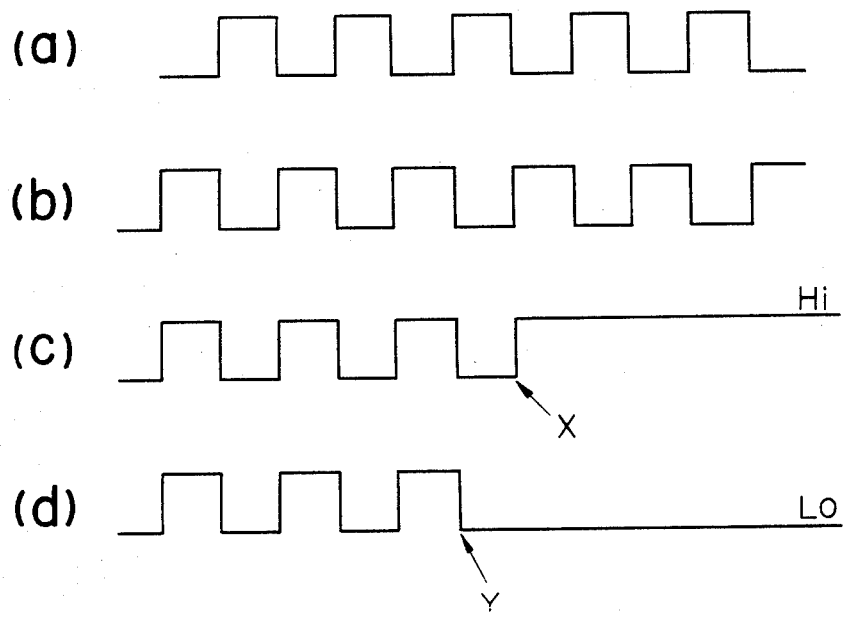
FIG. 8 shows wave forms of various signals, in which a represents a signal issued from the oscillator shown in FIG. 7, b a signal issued from the sensor circuit shown in FIG. 7, when no liquid is detected by the sensing elements shown in FIG. 6, c a signal from the sensor circuit shown in FIG. 7, when the liquid or either bubbles or the splash thereof is detected by the sensing elements shown in FIG. 6, and d a signal issued from the sensor circuit shown in FIG. 7, when a dispensation selection switch button arranged on the dispensing nozzle is pushed down.

The dispensation selection switch 281 is connected in parallel with the phototransistor 462, and if the switch is pressed down, the terminal $T_1$ is grounded and thus the output signal of the comparator 82 becomes a low level signal Lo [This signal is shown in FIG. 8(*d*), the switch being pressed down at point Y].

The output signal of the comparator 82 is led from its output terminal $T_3$ to the judging circuit 84 to make various judgments and resulting signal is fed to the subsequent circuit (see FIG. 2) to use the same mainly as a control signal and secondarily to convert the same to an audible and/or visible signal to inform the operator, as referred to hereinafter.

When the dispensing nozzle 28 is demounted from the nozzle hanger 30 (FIG. 1), the environmental medium for the liquid level sensor 46 is air and thus the pulse signal as shown in FIG. 8(*b*) is fed from the comparator 82 to the judging circuit 84. On receiving the pulse signal, the judging circuit 84 judges that the liquid level sensor is operating normally, to issue a corresponding judgment signal. Based on this judgment signal, a motor driving signal is fed to the motor control circuit 361 to actuate the electric motor 36 and a valve opening signal is fed to the valve control circuit 184 to open the valve mechanism for the flow control valve 40 (FIG. 2). The fuel dispensation operation can be started by manually operating the dispensing lever 58 of the nozzle 28 (FIG. 5). During the dispensation operation, the pulse encoder 381 of the flow meter 38 converts the amount of fuel passing through the same into a corresponding pulse signal to feed the same to the counter circuit 181 which counts the number of pulses to feed same to the indicator for displaying the fuel amount dispensed.

If a signal to be fed from the comparator 82 to the judging circuit 84 is not the one as illustrated in FIG. 8(*b*) when the nozzle 28 was demounted from its hanger 30 prior to the actual fuel dispensing operation, the judging circuit 84 judges that the liquid level sensor 84 is in an abnormal state, and issues a corresponding judgment signal to feed the same to the trouble indicator 24 for transmitting the matter to the operator, so that he can take a suitable counter measure thereto, for instance exchange the defective liquid level sensor.

Returning now to the fuel dispensing operation, the liquid level sensor 46 will detect the fuel per se, bubble thereof raising up prior to the actual fuel level or splash thereof due to the fuel charged in the vehicle fuel tank from the nozzle 28, when the dispensing operation is continuously carried out. The fuel detection is shown in FIG. 8(*c*) by the point X and at this time, the comparator 82 issues the high level signal Hi to feed the same to the judging circuit 84. The judging circuit 84 then judges the signal Hi to feed the valve closing signal to the valve control circuit 184, so that the valve mechanism for the flow control valve 40 is closed to stop the fuel dispensation.

If the fuel detection is a temporary one due to contact of the liquid level sensor 46 with a bubble or splash of fuel and thus the liquid level sensor 46 then detects air again, the pulse signal as shown in FIG. 8(*b*) is again fed from the comparator 82 to the judging circuit 84 to recommence the fuel dispensing operation but explanation thereabout will not be made, since this has already been done with reference to the time chart illustrated in FIG. 3.

If the fuel dispensation selection switch 281 arranged on the nozzle 28 is pressed down, the low level signal Lo is fed from the comparator 82 to the judging circuit 84, as referred to before [the time when the switch 281 is operated is shown by the point Y in FIG. 8(*d*)]. The low level signal Lo is transmitted to the valve control circuit 184 to fully open the valve mechanism for the flow control valve 40 and thus the valve mechanism repeats full open-full close operations due to the signal from the liquid level sensor 46 until the liquid level sensor 46 becomes in a state of continuously detecting the fuel.

A preferred embodiment of the flow control valve 40 will now be explained in detail with reference to FIG. 9.

The flow control valve 40 comprises a valve housing 90 having an inlet 92 and an outlet 94 and in which there is formed a valve seat 901 to receive a valve body 902. The valve body 902 has a hollow cylindrical configuration, an aperture 902*b* in its side wall 902*a* to control the position of the valve body 902, a guide 96 with a central flow passage 961, and a passage or longitudinal channel 902*c* formed in an inner surface of the side wall 902*a* to communicate a chamber 98 with the flow passage 961.

On the valve housing 90, there is mounted a casing 100 for accommodating a driving mechanism for the valve body 902. An inner space of the casing 100 is separated into two compartments. The first compartment constitutes the chamber 98 and accommodates a spring 102 to push the valve body 902 normally toward the valve seat 901, a receiver 104 for the spring 102, and a bellows 106 to movably support the receiver 104. An output shaft 108*a* of a stepping motor 108 projects into the second compartment of casing 100 and has a lever 110 attached to its free end. The rotation of stepping motor 108 by the signal from the valve control circuit 184 as described with reference to FIG. 2 is set so as to cause movement of the lever 110 between the solid line position and the broken line position in FIG. 9 with the aid of the output shaft 108*a*. A free end of the lever 110 is pivoted to a valve body driving rod 112 which is connected through a guide member 114 with a planted pin 114*a* to a needle valve rod 116 having at its free end a piston 118 with a poppet 118*a* to open or close the flow passage 961. A compression spring 120 is arranged between the piston 118 and the guide member 114 to normally close the flow passage 961 with the poppet 118*a*.

Figure 9:
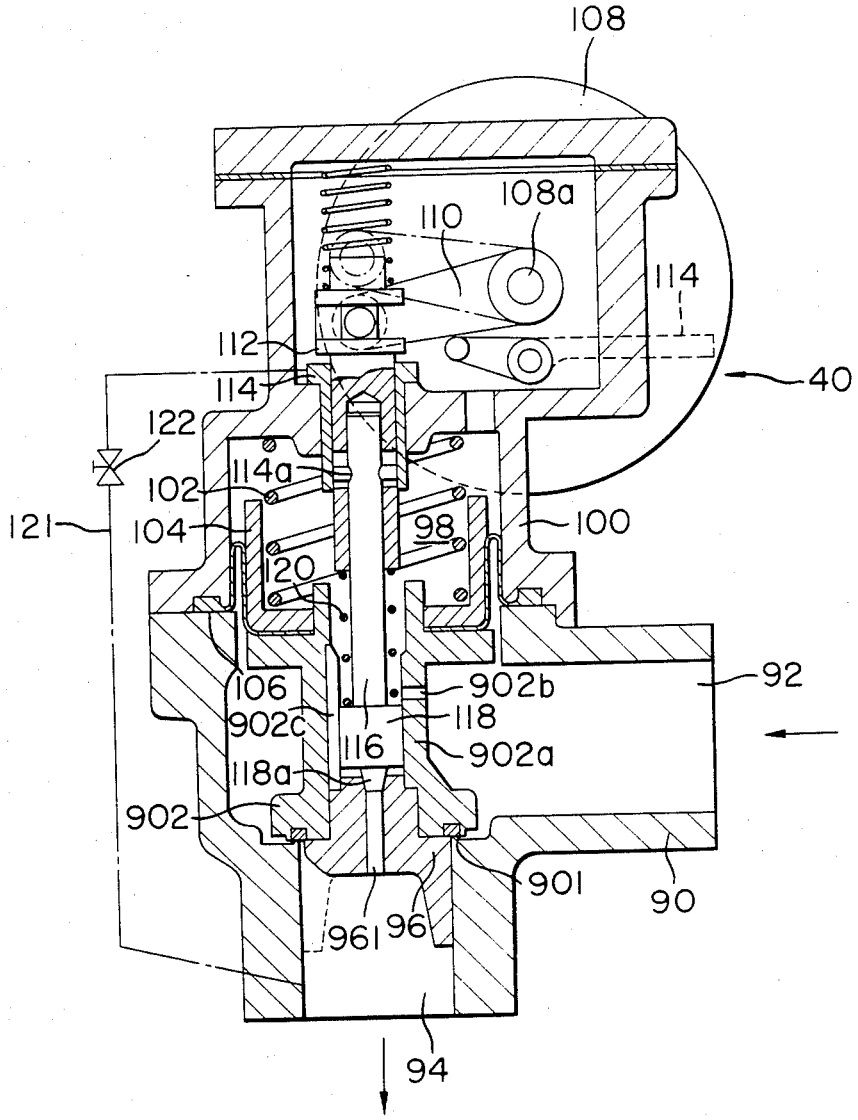
FIG. 9 is a vertical sectional view showing a flow control valve.

In the operation of the flow control valve 40, it is assumed that the lever 110 is in the position as shown in solid lines in FIG. 9. Since a pressure due to actuation of the pump 34 is applied to the inlet 92, the fuel flows through the aperture 902*b* into the hollow valve body 902 and then into the chamber 98 to press the valve body 902. Therefore, the inlet 92 is not communicated with the outlet 94 to prevent any flow out of the fuel from the outlet. If the stepping motor 108 is then rotated stepwise in response to a number of pulses by a pulse signals from the valve control circuit 184 (for instance 0.45° per pulse), the lever 110 correspondingly rotates clockwise to cause an upwardly movement of the piston 118 in FIG. 9, so that the fuel in the chamber 98 flows out from the outlet 94 through the passages 902*c* and 961 to reduce the pressure in the chamber 98. This pressure reduction causes an upper movement of the valve body 902 to provide communication between the inlet 92 and the outlet 94, whereby the fuel flows through the inlet and outlet. At the beginning of this operation, the fuel flows from the inlet 92 to the outlet 94 through the aperture 902*b* as well as passages 902*c* and 961. But if the piston 118 raises more to close the aperture 902*b*, the fuel does not enter the chamber 98, and thus the pressure in the chamber 98 reduces to cause the upper movement of the valve body 902. In other words, the position of the valve body 902 depends on the positional relation between the piston 118 and the aperture 903*b*, namely the amount of fuel flow into and flow-out from the chamber 98. Expressed another way, if the piston 118 is in its upper (or lower) position, the valve body 902 is also in its upper (or lower) position and thus the valve opening depends on the position of the lever 110 due to the rotation of the stepping motor 108.

As a precautional measure to possible interruption of the electric supply or trouble with the stepping motor 108, another lever 114 for actuating the lever 110 or the combination of a passage 121 communicating between the outlet 94 and the chamber 98 and a valve 122 arranged in the passage 121 may be provided.

The flow control valve 40 with such mechanism and operated in the manner as described is quite suitable for the apparatus according to the invention, since the needle valve rod 116 can rapidly be actuated and stopped at an optional position, whereby the response of the valve mechanism is rapid and reliable, so as to be able to set any optional flow amount.

We claim:

1. Apparatus for dispersing a liquid comprising pump means for pumping said liquid, conduit means through which said liquid is pumped, flow meter means in said conduit means measuring the amount of liquid passing through said conduit means, control valve means in said conduit means for controlling the flow of said liquid through said conduit means, dispensing nozzle means connected to said conduit means for dispensing said liquid, a liquid sensor means mounted in an end portion of said nozzle means for sensing liquid in said end portion and transmitting a detecting signal when said liquid is sensed, a valve opening memory circuit storing memory of a plurality of valve opening positions for said control valve means, a valve control circuit operable upon receiving said detecting signal from said liquid sensor means to cause said valve opening memory circuit to transmit a control signal corresponding to any one of said plurality of valve opening positions, a counter circuit operable to receive a signal from said flow meter means and provide a counting signal indicative of the amount of liquid through said flow meter means, said counter circuit also being operable to provide an integral dispensing signal, and an integral dispensation control circuit responsive to said control signal and said detecting signal along with said integral dispensing signal to transmit a dispensing ceasing signal to said valve control circuit to close said control valve means after the apparatus has dispensed an amount of liquid which is rounded off to a predetermined digit.

2. Apparatus according to claim 1, wherein said valve control circuit is operable to close said control valve means from one of said plurality of valve opening positions upon receiving said detecting signal from said liquid sensor means, and timer means for feeding a timing signal to said valve control circuit a predetermined time after said closing of said control valve means to thereby open said control valve means to another of said valve opening positions.

3. Apparatus according to claim 2, wherein said integral dispensation control circuit is operable to transmit an operational signal to said counter circuit when said control valve means is at a predetermined valve opening position and when said liquid sensor means continues to transmit said detecting signal, said counter circuit being responsive to said operational signal to feed a signal to said integral dispensation control circuit such that the latter transmits said dispensing ceasing signal after said counting circuit has rounded off the amount of liquid to said predetermined digit.

4. Apparatus according to claim 3, wherein said predetermined valve opening position is the smallest valve opening position of said plurality of valve opening positions.

5. Apparatus according to claim 3, wherein said dispensing ceasing signal is transmitted after transmittal of said detecting signal, an additional amount of liquid being dispensed during the interval of time beginning when the last said detecting signal starts its transmission and ending with the transmittal of said dispensing ceasing signal.

6. Apparatus according to claim 5, wherein said interval of time is variable depending on the amount of said additional amount of liquid dispensed, the amount of said additional liquid being the amount necessary to obtain said rounding off to said predetermined digit.

7. Apparatus according to claim 6, wherein the amount of additional liquid does not exceed about 0.15 liters.

8. Apparatus according to claim 1, wherein said control valve means comprises a stepping motor, said valve control circuit being operable to deliver a fixed number of pulses to said stepping motor for each of said plurality of valve opening positions to sequentially and progressively reduce the liquid flow through said control valve means, whereby the liquid flow through said control valve means is decreased each time a detecting signal is transmitted by said liquid sensor means.

9. Apparatus according to claim 1, wherein said predetermined digit is zero.

10. Apparatus according to claim 1, wherein the amount of liquid rounded off is rounded off to a predetermined higher digit.

11. Apparatus according to claim 1, wherein the amount of liquid rounded off is rounded off to a predetermined digit which spans a double digit.

12. Apparatus according to claim 1 further comprising a level sensor judging circuit connected to said liquid sensor means through a barrier circuit and operable to transmit a normal signal indicating that said liquid sensor means is in an operable condition and an abnormal signal indicating that said liquid sensor means is in an inoperable condition.

13. Apparatus according to claim 1, wherein said liquid sensor means comprises light emission means and light receiving means.

14. Apparatus according to claim 13, wherein said light emission means is a light emission diode operable to emit a pulse beam and said light receiving means is a phototransistor which is actuated to its through-state upon receiving the beam from said diode.

15. Apparatus according to claim 14, wherein said liquid sensor means further comprises lens means arranged to respectively make the light beam emitted from said light emission diode parallel and to make the parallel beam converge on said phototransistor.

16. Control apparatus for a liquid dispensing system which includes a flow control means and a dispensing nozzle, comprising a liquid sensor means mounted in an end portion of said dispensing nozzle for sensing liquid in said end portion and transmitting a detecting signal when said liquid is sensed, a valve opening memory circuit storing memory of a plurality of valve opening positions for said flow control means, a valve control circuit operable upon transmission of said detecting signal from said liquid sensor means to cause said valve opening memory circuit to transmit a delivery signal corresponding to any one of said plurality of valve opening positions, a counter circuit operable to provide a counting signal indicative of the amount of flow of liquid to the dispensing nozzle, said counter circuit also being operable to provide an integral dispensing signal, and an integral dispensation control circuit responsive to said delivery signal and said detecting signal along with said integral dispensing signal to transmit a dispensing ceasing signal to said valve control circuit means to close said flow control means such that the apparatus will dispense an additional amount of liquid after said liquid sensor means commences transmittal of said detecting signal, said additional amount of liquid being an amount which rounds off the dispensed amount to a predetermined digit.

17. Control apparatus for a liquid dispensing system which includes a flow control means and a dispensing nozzle placeable into a container opening for dispensing said liquid into the container, comprising a liquid sensor means mounted on said dispensing nozzle for sensing liquid and transmitting a detecting signal when the level of said liquid in said container reaches said liquid sensor means, valve control circuit means operable to close said flow control means, a counter circuit means operable to provide a counting signal indicative of the amount of flow of liquid to the dispensing nozzle, said counter circuit means being operable to provide an integral dispensing signal, and an integral dispensation control circuit operable to receive said detecting signal along with said integral dispensing signal to transmit a dispensing ceasing signal to said valve control circuit to close said flow control means after the level of the liquid passes the first said level such that the apparatus will dispense an additional amount of liquid above said first level which is rounded off to a predetermined digit.

* * * * *